US007540165B2

(12) United States Patent
DiFoggio et al.

(10) Patent No.: US 7,540,165 B2
(45) Date of Patent: Jun. 2, 2009

(54) DOWNHOLE SORPTION COOLING AND HEATING IN WIRELINE LOGGING AND MONITORING WHILE DRILLING

(75) Inventors: Rocco DiFoggio, Houston, TX (US); Paul A. Bergren, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 348 days.

(21) Appl. No.: 11/585,732

(22) Filed: Oct. 24, 2006

(65) Prior Publication Data

US 2007/0095096 A1 May 3, 2007

Related U.S. Application Data

(63) Continuation of application No. 10/847,243, filed on May 17, 2004, now Pat. No. 7,124,596, which is a continuation-in-part of application No. 10/232,446, filed on Aug. 30, 2002, now Pat. No. 6,877,332, which is a continuation-in-part of application No. 10/036,972, filed on Dec. 21, 2001, now Pat. No. 6,672,093, which is a continuation-in-part of application No. 09/756,574, filed on Jan. 8, 2001, now Pat. No. 6,341,498.

(51) Int. Cl.
*F25D 23/12* (2006.01)

(52) U.S. Cl. ..... 62/259.2; 62/271

(58) Field of Classification Search ..... 62/259.2, 62/268, 271, 480, 481; 165/302
See application file for complete search history.

(56) References Cited

U.S. PATENT DOCUMENTS 2,144,441 A * 1/1939 Schlumbohm ..... 62/106
3,642,059 A * 2/1972 Greiner ..... 165/104.12
4,205,531 A 6/1980 Brunberg et al.
4,250,720 A 2/1981 Siegel
4,375,157 A 3/1983 Boesen
4,407,136 A 10/1983 de Kanter
4,703,629 A 11/1987 Moore
4,742,868 A 5/1988 Mitani et al.
4,949,549 A 8/1990 Steidl et al.
5,008,664 A 4/1991 More et al.
5,144,245 A 9/1992 Wisler
5,213,593 A 5/1993 White, Jr.
5,280,243 A 1/1994 Miller
5,503,222 A 4/1996 Dunne
5,816,311 A 10/1998 Osada et al.
5,931,000 A 8/1999 Turner et al.
5,931,005 A 8/1999 Garrett et al.
6,000,468 A 12/1999 Pringle
6,112,809 A 9/2000 Angle
6,134,892 A 10/2000 Turner et al.

* cited by examiner

*Primary Examiner*—Melvin Jones
(74) *Attorney, Agent, or Firm*—Madan, Mossman & Sriram, P.C.

(57) ABSTRACT

A cooling system in which an electronic device or other component is cooled by using one or more solid sources of liquid vapor (such as polymeric absorbents, hydrates or desiccants that desorb water at comparatively low temperature) in conjunction with one or more high-temperature vapor sorbents or desiccants that effectively transfer heat from the component to the fluid in the wellbore. Depending on the wellbore temperature, desiccants are provided that release water at various high regeneration temperatures such as molecular sieve (220-250° C.), potassium carbonate (300° C.), magnesium oxide (800° C.) And calcium oxide (1000° C.). A solid water source is provided using a water-absorbent polymer, such as sodium polyacrylate. Heat transfer is controlled in part by a check valve selected to release water vapor at a selected vapor pressure.

18 Claims, 8 Drawing Sheets

J.T. Baker Desiccant Selection Guide

Sorted by Regeneration Temperatures 1310 1320

| Drying Agent | Product Number | Size | Suitable for Drying | Not Suitable for Drying | Residual Water, mg $H_2O$/L Dried | Density g/cc | g $H_2O$/g Desiccant | cc $H_2O$/cc Desiccant | Regeneration Temperature | Regeneration Mechanism |
|---|---|---|---|---|---|---|---|---|---|---|
| Zinc Chloride Reagent, Broken Lump | 4321-01<br>4321-05<br>4321-07 | 500 g<br>2.5 kg<br>12 kg | Hydrocarbons | Ammonia, amines, alcohol | 0.9 | 2.91<br>2.91<br>2.91 | 0.2 | 0.582 | 110°C | Hydration |
| Sodium Sulfate Anhydrous Powder | 3898-01<br>3898-05<br>3898-07 | 500 g<br>2.5 kg<br>12 kg | Alkyl halides, aryl halides, aldehydes, ketones, | | 12 | 2.68<br>2.68<br>2.68 | 1.2 | 3.216 | 150°C | Hydration |
| Sodium Sulfate Anhydrous Granular (12-60 mesh) | 3375-01<br>3375-05<br>3375-07 | 500 g<br>2.5 kg<br>12 kg | Alkyl halides, aryl halides, aldehydes, ketones, | | 12 | 2.68<br>2.68<br>2.68 | 1.2 | 3.216 | 150°C | Hydration |
| Sodium Sulfate Anhydrous Granular Powder | 3891-01<br>3891-05<br>3891-07 | 500 g<br>2.5 kg<br>12 kg | Alkyl halides, aryl halides, aldehydes, ketones, | | 12 | 2.68<br>2.68<br>2.68 | 1.2 | 3.216 | 150°C | Hydration |
| Aluminum Oxide | 0536-01<br>0536-05 | 500 g<br>2.5 kg | Hydrocarbons, air, ammonia. | | 0.003 | 4<br>4 | 0.2 | 0.8 | 175°C | Chemisorption Adsorption |
| Cupric Sulfate | 1850-01<br>1850-05 | 500 g<br>2.5 kg | Esters, alcohols (excellent for | Acid sensitive compounds | 1.4 | 3.6<br>3.6 | 0.6 | 2.16<br>0 | 200°C | |
| Magnesium Sulfate | 2506-01<br>2506-05 | 500 g<br>2.5 kg | Most compounds, incl. Acids. | Acid sensitive compounds | 1 | 2.65<br>2.65 | 0.2 - 0.8 | 0.53 - 2.12 | 200°C and red heat | Hydration |

FIG. 5A

1310 / 1320

| | | | | | | | | | | |
|---|---|---|---|---|---|---|---|---|---|---|
| DRIERITE, Regular | L056-07<br>L056-02 | 454 g<br>2.3 kg | Air, industrial gases, refrigerants, | | 0.005 | 2.96<br>2.96 | 0.066 | 0.19536 | 210°C for 1 hour | Hydration |
| DRIERITE, Indicating(4 Mesh)<br>(8 Mesh)<br>(10-20 Mesh) | L057-07<br>L057-02<br>L058-07<br>L058-02<br>L059-07 | 454 g<br>2.3 kg<br>454 g<br>2.3 kg<br>454 g | Air, industrial gases, refrigerants, organic liquids and solids. | | 0.005 | 1.87<br>1.87<br>1.87<br>1.87<br>1.87<br>1.87<br>1.87 | 0.066 | 0.12342 | 210°C for 1 hour | Hydration |
| Calcium Sulfate | 1458-01 | 500 g | Most organic compounds | | 0.005 | 2.96 | 0.066 | 0.19536 | 235°C | Adsorption |
| Molecular Sieve Activated Type 3A 8-12 Mesh | 2710-01<br>2710-05 | 500 g<br>2.5 kg | Molecules of diameter > 3 angstroms | Molecules of diameter < 3 angstroms | | 2.1<br>2.1 | 0.18 | 0.378<br>0 | 117-260°C | Adsorption |
| Molecular Sieve Activated 8-12 Mesh indicating Type 4A | 2707-01<br>2708-01<br>2708-05 | 500 g<br>500 g<br>2.5 kg | Molecules of diameter > 4 angstroms | Molecules of diameter < 4 angstroms Ethanol, $H_2S$ $CO_2$, $SO_2$ | 0.001 | 2.1<br>2.1<br>2.1 | 0.18 | 0.378 | 250°C | Adsorption |
| Molecular Sieve Activated (8-12 Mesh) Type 5A | 2709-01<br>2709-05 | 500 g<br>2.5 kg | Molecules of diameter > 5 angstroms | Molecules of diameter < 5 angstroms | 0.003 | 2.1<br>2.1 | 0.18 | 0.378 | 250°C | Adsorption |
| ANHYDRONE® (Magnesium Perchlorate anhydrous) | 0828-01 | 500 g | inert gas, air | ** Most organics | 0.001 | 2.6 | 0.2 | 0.52 | 250°C with vacuum | Hydration |
| Calcium Chloride (20 Mesh) | 1311-01<br>1311-05 | 500 g<br>2.5 kg | Alkyl and Aryl Halides, most esters | Alcohols, amines, phenols, | 0.14-0.25 | 2.15<br>2.15 | 0.2 ($1H_2O$)<br>0.2 ($2H_2O$) | 0.43<br>0.65 | 250°C | Hydration |
| Calcium Chloride (4-8 Mesh) | 1313-01<br>1313-05 | 500 g<br>2.5 kg | Alkyl and Aryl Halides, most esters | Alcohols, amines, phenols, | 0.14-0.25 | 2.15<br>2.15 | 0.2 ($1H_2O$)<br>0.2 ($2H_2O$) | 0.43<br>0.65 | 250°C | Hydration |
| Silica Gel indicating 6-16Mesh | 3401-01<br>3401-05 | 500 g<br>2.5 kg | Most organics | HF vapors | 0.03 | 2.1<br>2.1 | 0.2 | 0.42 | 200-350°C | Adsorption |
| Potassium Carbonate | 3012-01<br>3012-05 | 500 g<br>2.5 kg | Alcohols, nitriles, ketones | acid, phenols | | 2.29<br>2.29 | 0.2 | 0.458 | 300°C | Hydrate Formation |

FIG. 5B 1310 1320

| | | | | | | | | | | | |
|---|---|---|---|---|---|---|---|---|---|---|---|
| Boric Anhydride | 1176-01<br>1176-05 | 500 g<br>2.5 kg | Formic Acid | | | 1.85<br>1.85 | 0.8 | 0.148 | 450°C | |
| Magnesium Oxide | 2476-01 | 500 g | Hydrocarbons, aldehydes, alcohols, basic gases, | Acidic compounds | 0.008 | 3.58 | 0.5 | 0.179 | 800°C | Hydration |
| Calcium Oxide | 1410-01<br>1410-05 | 500 g<br>2.5 kg | Alcohols, amines and | Acidic compounds, | 0.007 | 3.37<br>3.37 | 0.03 | 1.011 | 1000°C | Chemisorption |
| Barium Oxide | B656-04 | 125 g | Organic bases, alcohols, aldehydes, | | 0.0065 | | 0.1 | | Not Recommended | Absorption and Adsorption |
| Lithium Aluminum Hydride | P403-05 | 100 g | Aldehydes, ketones, esters, carboxylic acids, peroxides, acid anhydrides, acid chlorides, | Acids and its derivatives, aromatic nitro compounds | | | | | ? | |
| Phosphoric Acid | 0260-01<br>0260-03 | 500 ml<br>2.5 L | | | 0.003 | | | | Not Recommended | Absorption Solution |
| Phosphorous Pentoxide | 2550-01 | 500 g | Saturated hydrocarbons, aromatic hydrocarbons, ethers, alkyl halides, aryl halides, nitriles, anhydrides, nitrites, esters | Alcohols, acids, amines, ketones, HF and HCl vapors | $3x10^{-5}$ | | 0.5 | | No | Chemisorption leading to $H_3PO_4$ |

FIG. 5C 1310 1320

| | | | | | | | | | | |
|---|---|---|---|---|---|---|---|---|---|---|
| Potassium Hydroxide | 3140-01<br>3140-05<br>3140-07 | 500 g<br>2.5 kg<br>12 kg | Amines, organic bases | Acids, phenols, esters, amides, acidic | 0.3 | | Indeterminate | | No | Hydration and Solution Formation |
| Sodium | 9410-04<br>9410-01 | 113 g<br>2.5 kg | Saturated and aromatic hydrocarbons, ethers | Acids, alcohols, aldehydes, ketones, | | | | | Not Recommended | Leads to $NaOH + H_2$ |
| Sodium Hydroxide Pellets | 3722-01<br>3722-05<br>3722-07 | 500 g<br>2.5 kg<br>12 kg | Amines | Acids, phenols, esters, amines, | 0.16 | | Indefinate | | Not Recommended | Absorption and Solution Formation |
| Sulfuric Acid | 9681-01<br>9681-03 | 500 ml<br>2.5 L | Inert gases, HCl, $Cl_2$, CO | Too reactive to actually | 0.003 | | Indefinate | | No | Hydration |

** May form explosive compound when exposed to organic vapors.

ANHYDRONE® is a registered trademark of Mallinckrodt Baker, Inc.

FIG. 5D

DOWNHOLE SORPTION COOLING AND HEATING IN WIRELINE LOGGING AND MONITORING WHILE DRILLING

CROSS REFERENCE TO RELATED APPLICATIONS

This patent application is a continuation and claims priority from U.S. patent application Ser. No. 10/847,243 filed on May 17, 2004 entitled "Downhole Sorption Cooling and Heating in Wire line Logging and Monitoring While Drilling" by Rococo DiFoggio et al, which is incorporated herein by reference in its entirety, now U.S. Pat. No. 7,124,596 which is a continuation-in-part of and claims priority from U.S. patent application Ser. No. 10/232,446 filed on Aug. 30, 2002, now U.S. Pat. No. 6,877,332 entitled "Downhole Sorption Cooling of Electronics in Wire line Logging and Monitoring While Drilling" by Rococo DiFoggio, which is also a continuation-in-part of and claims priority from U.S. patent application Ser. No. 10/036,972 filed on Dec. 21, 2001, now U.S. Pat. No. 6,672,093 entitled "Downhole Sorption Cooling of Electronics in Wire line Logging and Monitoring While Drilling" by Rococo DiFoggio, which is also a continuation-in-part of and claims priority from U.S. patent application Ser. No. 09/756,574 filed on Jan. 8, 2001, now U.S. Pat. No. 6,341,498 entitled "Downhole Sorption Cooling of Electronics in Wire line Logging and Monitoring While Drilling" by Rococo DiFoggio.

BACKGROUND OF THE INVENTION

1. Field of the Invention

This present invention relates to a downhole tool for wireline or monitoring while drilling applications, and in particular relates to a method and apparatus for sorption cooling of sensors and electronics and heating of chambered samples deployed in a downhole tool suspended from a wireline or a drill string.

2. Summary of Related Art

In underground drilling applications, such as oil and gas or geothermal drilling, a bore hole is drilled through a formation deep in the earth. Such bore holes are drilled or formed by a drill bit connected to the end of a series of sections of drill pipe, so as to form an assembly commonly referred to as a "drill string." The drill string extends from the surface to the bottom of the bore hole. As the drill bit rotates, it advances into the earth, thereby forming the bore hole. In order to lubricate the drill bit and flush cuttings from its path as it advances, a high pressure fluid, referred to as "drilling mud," is directed through an internal passage in the drill string and out through the drill bit. The drilling mud then flows to the surface through an annular passage formed between the exterior of the drill string and the surface of the bore.

The distal or bottom end of the drill string, which includes the drill bit, is referred to as a "downhole assembly." In addition to the drill bit, the downhole assembly often includes specialized modules or tools within the drill string that make up the electrical system for the drill string. Such modules often include sensing modules. In many applications, the sensing modules provide the drill string operator with information regarding the formation as it is being drilled through, using techniques commonly referred to as "measurement while drilling" (MWD) or "logging while drilling" (LWD). For example, resistivity sensors may be used to transmit and receive high frequency signals (e.g., electromagnetic waves) that travel through the formation surrounding the sensor.

As can be readily appreciated, such an electrical system will include many sophisticated electronic components, such as the sensors themselves, which in many cases include printed circuit boards. Additional associated components for storing and processing data in the control module may also be included on printed circuit boards. Unfortunately, many of these electronic components generate heat. For example, the components of a typical MWD system (i.e., a magnetometer, accelerometer, solenoid driver, microprocessor, power supply and gamma scintillator) may generate over 20 watts of heat. Moreover, even if the electronic component itself does not generate heat, the temperature of the formation itself typically exceeds the maximum temperature capability of the components.

Overheating frequently results in failure or reduced life expectancy for thermally exposed electronic components. For example, photo multiplier tubes, which are used in gamma scintillators and nuclear detectors for converting light energy from a scintillating crystal into electrical current, cannot operate above 175° C. Consequently, cooling of the electronic components is important. Unfortunately, cooling is made difficult by the fact that the temperature of the formation surrounding deep wells, especially geothermal wells, is typically relatively high, and may exceed 200° C.

Certain methods have been proposed for cooling electronic components in applications associated with the monitoring and logging of existing wells, as distinguished from the drilling of new wells. One such approach, which requires isolating the electronic components from the formation by incorporating them within a vacuum insulated Dewar flask, is shown in U.S. Pat. No. 4,375,157 (Boesen). The Boesen device includes thermoelectric coolers that are powered from the surface. The thermoelectric coolers transfer heat from the electronics area within the Dewar flask to the well fluid by means of a vapor phase heat transfer pipe. Such approaches are not suitable for use in drill strings since the size of such configurations makes them difficult to package into a downhole assembly.

Another approach, as disclosed in U.S. Pat. No. (Owens) involves placing a thermoelectric cooler adjacent to an electronic component or sensor located in a recess formed in the outer surface of a well logging tool. This approach, however, does not ensure that there will be adequate contact between the components to ensure efficient heat transfer, nor is the electronic component protected from the shock and vibration that it would experience in a drilling application.

Thus, one of the prominent design problems encountered in downhole logging tools is associated with overcoming the extreme temperatures encountered in the downhole environment. Thus, there exists a need to reduce the temperature within the downhole tool in the region containing the electronics, to the within the safe operating level of the electronics. Various schemes have been attempted to resolve the temperature differential problem to keep the tool temperature below the maximum electronic operating temperature, but none of the known techniques have proven satisfactory.

Downhole tools are exposed to tremendous thermal strain. The downhole tool housing is in direct thermal contact with the bore hole drilling fluids and conducts heat from the bore hole drilling fluid into the downhole tool housing. Conduction of heat into the tool housing raises the ambient temperature inside of the electronics chamber. Thus, the thermal load on a non-insulated downhole tool's electronic system is enormous and can lead to electronic failure. Electronic failure is time consuming and expensive. In the event of electronic failure, downhole operations must be interrupted while the downhole tool is removed from deployment and repaired. Thus, various methods have been employed in an attempt to reduce the thermal load on all the components, including the electronics and sensors inside of the downhole tool. To reduce the thermal load, downhole tool designers have tried surrounding electronics with thermal insulators or placed the electronics in a vacuum flask. Such attempts at thermal load reduction, while partially successful, have proven problematic in part because of heat conducted from outside the electronics chamber and into the electronics flask via the feed-through wires connected to the electronics. Moreover, heat generated by the electronics trapped inside of the flask also raises the ambient operating temperature.

Typically, the electronic insulator flasks have utilized high thermal capacity materials to insulate the electronics to retard heat transfer from the bore hole into the downhole tool and into the electronics chamber. Designers place insulators adjacent to the electronics to retard the increase in temperature caused by heat entering the flask and heat generated within the flask by the electronics. The design goal is to keep the ambient temperature inside of the electronics chamber flask below the critical temperature at which electronic failure may occur. Designers seek to keep the temperature below critical for the duration of the logging run, which is usually less than 12 hours.

Electronic container flasks, unfortunately, take as long to cool down as they take to heat up. Thus, once the internal flask temperature exceeds the critical temperature for the electronics, it requires many hours to cool down before an electronics flask can be used again safely. Thus, there is a need to provide an electronics and or component cooling system that actually removes heat from the flask or electronics/sensor region without requiring extremely long cool down cycles which impede downhole operations. As discussed above, electronic cooling via thermoelectric and compressor cooling systems has been considered, however, neither have proven to be viable solutions.

Thermoelectric coolers require too much external power for the small amount of cooling capacity that they provide. Moreover, few if any of the thermoelectric coolers are capable of operating at downhole temperatures. Additionally, as soon as the thermoelectric cooler system is turned off, the system becomes a heat conductor that enables heat to rapidly conduct through the thermoelectric system and flow back into the electronics chamber from the hotter regions of the downhole tool. Compressor-based cooling systems also require considerable power for the limited amount of cooling capacity they provide. Also, most compressors seals cannot operate at the high temperatures experienced downhole because they are prone to fail under the thermal strain.

Thus, there is a need for a cooling system that addresses the problems encountered in known systems discussed above. Consequently, it would be desirable to provide a rugged yet reliable system for effectively cooling the electronic components and sensors utilized downhole that is suitable for use in a wellbore. It is desirable to provide a cooling system that is capable of being used in a downhole assembly of a drill string or wireline.

Another problem encountered during downhole operations is cooling and associated depressurization of hydrocarbon samples taken into a downhole tool. As the tool is retrieved from the bore hole the sample cools and depressurizes. Thus there is a need for heating method and apparatus to prevent cooling and depressurization of downhole hydrocarbon samples.

SUMMARY OF THE INVENTION

It is an object of the current invention to provide a rugged yet reliable system for effectively cooling the electronic components that is suitable for use in a well, and preferably, that is capable of being used in a downhole assembly of a drill string or wire line. This and other objects is accomplished in a sorption cooling system in which an electronic component or sensor is juxtaposed with one or more sorbent coolers that facilitate the transfer of heat from the component to the wellbore. Depending on the wellbore temperature, desiccants that release water at various high regeneration temperatures are used such as molecular sieve (220-250° C.), potassium carbonate (300° C.), magnesium oxide (800° C.) And calcium oxide (1000° C.). A solid source of water is provided using a water-absorbent polymer, such as sodium polyacrylate or a low-regeneration-temperature desiccant. Heat transfer is controlled in part by a check valve selected to release water vapor at a selected vapor pressure.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein:

FIG. 5 is an illustration of a list of examples of desiccants having differing temperature ranges at which they release water.

DETAILED DESCRIPTION OF THE INVENTION

Figure 1:
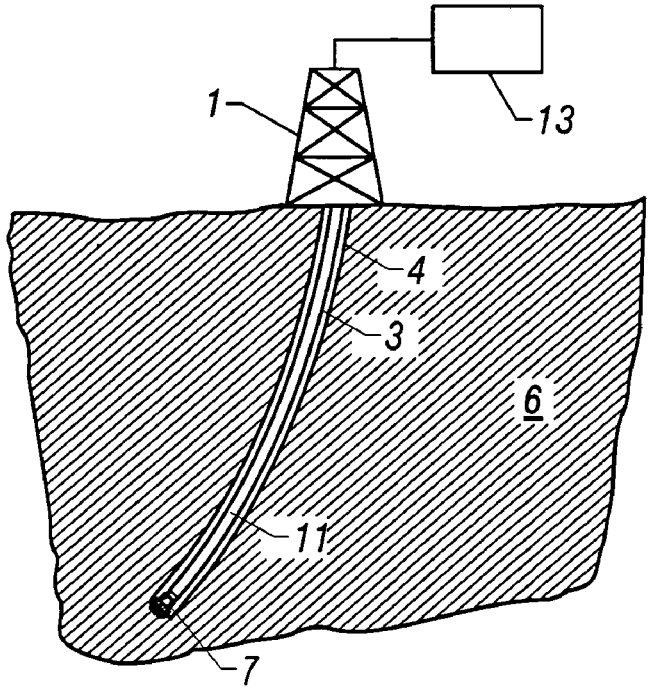
FIG. 1 is an illustration of a preferred embodiment of the present invention shown in a monitoring while drilling environment.

The present invention provides a structure and method for a downhole tool component cooling system. The downhole tool component cooling system of the present invention does not require an external electrical power source. The cooling system of the present invention utilizes the potential energy of sorption to remove heat from a temperature sensitive tool component. The sorption energy removes heat from the tool component and moves the heat to a second, hotter region in the downhole tool. The cooling region of the tool, adjacent to the temperature-sensitive component which is sorption cooled, contains a liquid source (such as water) which in the present example is a solid form of water to avoid spillage. The solid source of water releases its water as its temperature increases. Thus, this solid source of water can be a low-temperature hydrate, desiccant, sorbent, or polymeric absorber from which water (or some other liquid) vapor is generated when heated sufficiently. For example, sodium polyacrylate is a polymeric water absorber that can absorb up to 40 times its weight in water and still appear to be a dry solid.

Cooling occurs as a first portion of the solid source of water releases water vapor. Upon release from the first portion of the solid source of water, the remaining portion of this solid source of water is cooled, and this remaining portion in turn cools the adjacent thermally sensitive component, thereby keeping the adjacent component within a safe operating temperature with continued sorption cooling. Thus, the present invention provides a structure and method whereby the downhole electronics or other thermally-sensitive components are surrounded by or adjacent to a solid source of water, such as a low-temperature hydrate, desiccant, sorbent, polymeric absorber or some mixture of these. The solid source of water surrounding or adjacent to the electronics or thermally sensitive component is cooled by release of the water vapor (or other liquid vapor), thereby cooling the electronics or other thermally-sensitive component, e.g., a sensor.

According to the present example of the invention, a sorbent cooling system for use in a well, such as downhole tool in a drill string through which a drilling fluid flows, or a wire line comprises (i) a housing adapted to be disposed in a well and exposed to the fluid in the well, (ii) a solid source of liquid (e.g., a low-regeneration-temperature hydrate, desiccant, sorbent, or polymeric absorber that releases water when heated), adjacent to a thermally sensor or electronic component to be cooled, (iii) optionally, a Dewar flask lined with phase change material surrounding the electronics/sensor and liquid supply, (iv) optionally, a vapor passage for transferring vapor from the liquid supply; and (v) a high-temperature sorbent or desiccant in thermal contact with the housing for receiving and adsorbing the water vapor from the vapor passage and transferring the heat from the water vapor through the housing to the drilling fluid or wellbore. A desiccant is a specific type of sorbent, that is a substance that sorbs (adsorbs or absorbs) water. All desiccants are soreness but not all soreness are desiccants. The electronics or sensor adjacent to the low-temperature hydrate, desiccant, or sorbent is kept cool by the latent heat of fusion and heat of desorption.

Figure 2:
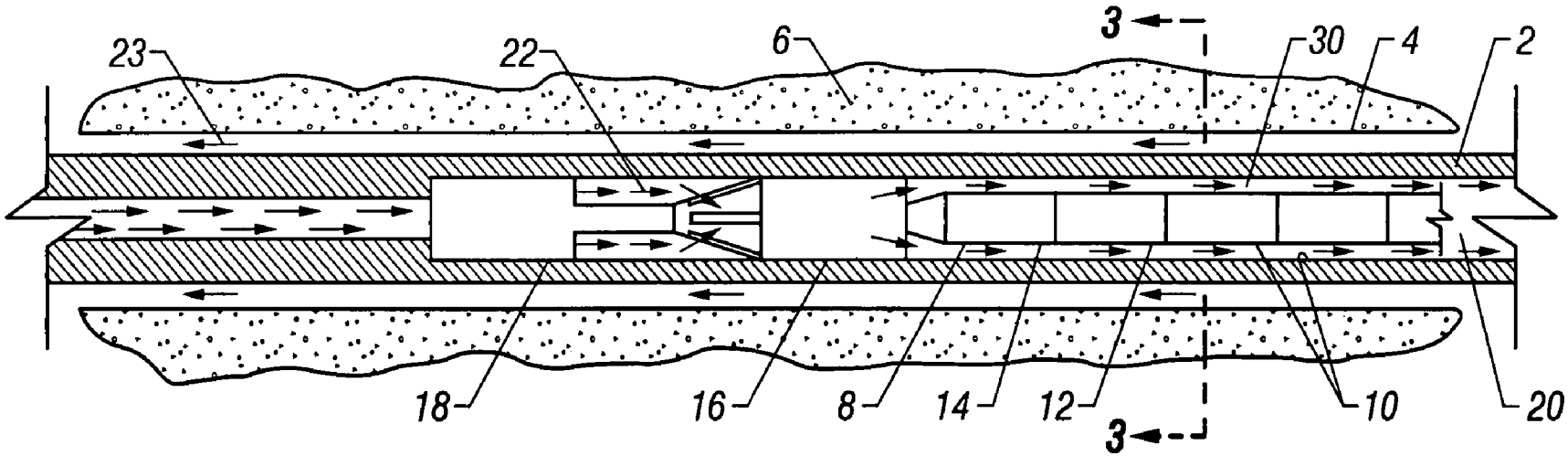
FIG. 2 is a longitudinal cross section through a portion of the down tool attached to the drill string as shown in FIG. 1 incorporating the sorbent cooling apparatus of the present invention.

A drilling operation according to the current invention is shown in FIG. 1. A drill rig 1 drives a drill string 3 that, which typically is comprised of a number of interconnecting sections. A downhole assembly 11 is formed at the distal end of the drill string 3. The downhole assembly 11 includes a drill bit 7 that advances to form a bore 4 in the surrounding formation 6. A portion of the downhole assembly 11, incorporating an electronic system 8 and cooling systems according to the current invention, is shown in FIG. 2. The electrical system 8 may, for example, provide information to a data acquisition and analysis system 13 located at the surface. The electrical system 8 includes one or more electronic components. Such electronic components include those that incorporate transistors, integrated circuits, resistors, capacitors, and inductors, as well as electronic components such as sensing elements, including accelerometers, magnetometers, photomultiplier tubes, and strain gages.

The downhole portion 11 of the drill string 3 includes a drill pipe, or collar, 2 that extends through the bore 4. As is conventional, a centrally disposed passage 20 is formed within the drill pipe 2 and allows drilling mud 22 to be pumped from the surface down to the drill bit. After exiting the drill bit, the drilling mud 23 flows up through the annular passage formed between the outer surface of the drill pipe 2 and the internal diameter of the bore 4 for return to the surface. Thus, the drilling mud flows over both the inside and outside surfaces of the drill pipe. Depending on the drilling operation, the pressure of the drilling mud 22 flowing through the drill pipe internal passage 20 will typically be between 1,000 and 20,000 pounds per square inch, and, during drilling, its flow rate and velocity will typically be in the 100 to 1500 GPM range and 5 to 150 feet per second range, respectively.

As also shown in FIG. 2, the electrical system 8 is disposed within the drill pipe central passage 20. The electrical system 8 includes a number of sensor modules 10, a control module 12, a power regulator module 14, an acoustic pulser module 18, and a turbine alternator 16 that are supported within the passage 20, for example, by struts extending between the modules and the drill pipe 2. According to the current invention, power for the electrical system 8, including the electronic components and sensors, discussed below, is supplied by a battery, a wireline or any other typical power supply method such as the turbine alternator 16, shown in FIG. 2, which is driven by the drilling mud 22. The turbine alternator 16 may be of the axial, radial or mixed flow type. Alternatively, the alternator 16 could be driven by a positive displacement motor driven by the drilling mud 22, such as a Moineau-type motor. In other embodiments, power could be supplied by any power supply apparatus including an energy storage device located downhole, such as a battery.

Figure 3:
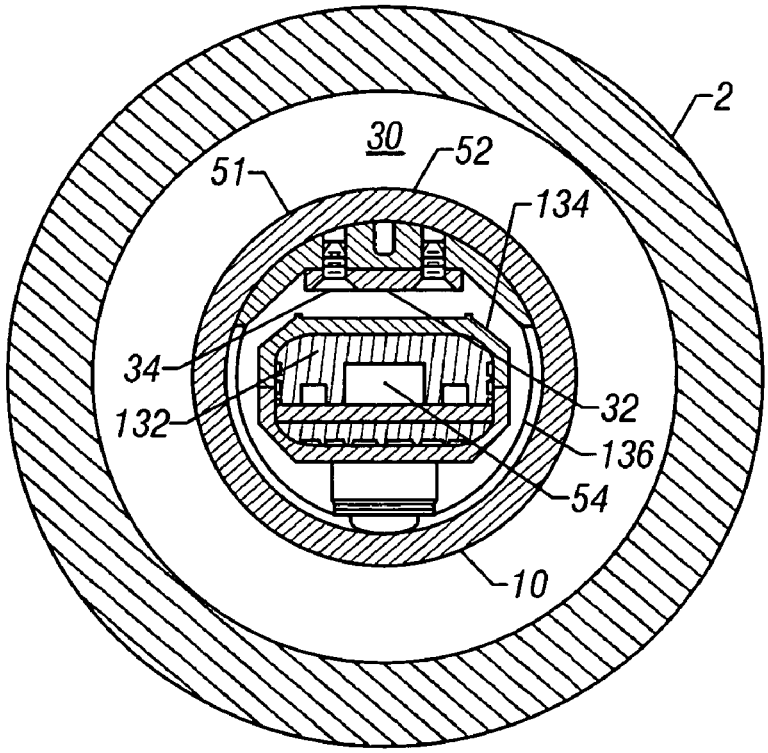
FIG. 3 is a schematic representation of an example of the present invention in operation down hole.

As shown in FIG. 3, each sensor module 10 is comprised of a cylindrical housing 52, which is preferably formed from stainless steel or a beryllium copper alloy. An annular passage 30 is formed between the outer surface 51 of the housing 52 and the inner surface of the drill pipe 2. The drilling mud 22 flows through the annular passage 30 on its way to the drill bit 7, as previously discussed. The housing 52 contains an electronic component 54 for the sensor module. The electronic component 54 may, but according to the invention does not necessarily, include one or more printed circuit boards including a processor associated with the sensing device, as previously discussed. Alternatively, the assembly shown in FIG. 3 comprises the control module 12, power regulator module 14, or pulser module 18, in which case the electronic component 54 may be different than those used in the sensor modules 10, although it may, but again does not necessarily, include one or more printed circuit boards. According to the current invention, one or more of the electronic components or sensors in the electrical system 8 are cooled by evaporation of liquid from the liquid supply 132 adjacent to or surrounding electronics 54. In an alternative embodiment as shown in FIG. 3, the electrical system, for example a clock which remains at a constant temperature, is cooled by the evaporation of a liquid provided by a low-temperature hydrate or desiccant 232 adjacent the electronics, e.g., an electronic clock.

A highly heat-conductive polymer is optionally provided proximate or touching the electronics or circuit board to facilitate heat removal from the electronics or circuit board, as shown in FIG. 4. These polymers are typically loaded with highly heat-conductive minerals. At room temperature, they feel quite cool to the touch because they quickly draw heat from one's fingers. Water is a particularly effective coolant. Evaporation of one liter of water removes 631.63 Watt-hours of energy, which equals 543 cal/ml. Water is also inexpensive, readily available worldwide, nontoxic, chemically stable, and poses no environmental disposal problems. Thus, evaporation of one liter of water can remove 632 Watts for one hour, 63 Watts for 10 hours, or 6.3 Watts for 100 hours. In the present example of the present invention, a low-temperature solid source of water is placed inside the cooling region of the downhole tool, preferably inside a Dewar flask. A high-temperature desiccant that is in thermal contact with the wellbore fluid adsorbs the water released by the low-temperature solid source of water. The high-temperature desiccant is chosen based on the desired operating temperature, that is, the temperature at which a desiccant releases water.

A partial list of suitable desiccants is shown in FIG. 5 with each desiccant's associated water release temperature, that is, the regeneration temperature for the desiccant. There are numerous other desiccants suitable which are not listed in FIG. 5. The list of FIG. 5 is not meant to be exhaustive, as other desiccants are suitable as well for use in the present invention. The Dewar flask or container, comprising a cooling chamber, is connected via a vapor passage, such as a tube, to a container of high-temperature desiccant located in a higher temperature heat sink region located elsewhere in the tool. The preferred high-temperature desiccant strongly sorbs water vapor, which has traveled from the evaporation (cooling) region through the vapor passage to the high-temperature desiccant in the heat sink region. The heat sink region, containing the desiccant is in efficient thermal contact with the downhole tool housing which is in thermal contact with the high temperature wellbore. The higher temperature desiccant sorbs the water vapor from the vapor passage at elevated temperatures, thereby keeping the vapor pressure low. Low vapor pressure facilitates additional water vapor release from the lower temperature water source, enabling additional cooling within the cooling chamber containing the evacuated electronics Dewar flask or other container surrounding or adjacent to the electronics in the cooling chamber.

In an exemplary embodiment, approximately 6.25 volumes of loosely packed high-temperature desiccant are utilized to sorb 1 volume of water. After each logging run, the high-temperature desiccant can either be discarded or regenerated. This higher temperature desiccant can be regenerated by heating it to the water release temperature to release the water or other liquid it has absorbed by the higher temperature desiccant during sorption cooling. Some soreness, referred to as desiccants, are able to selectively sorb water. Some desiccants retain sorbed water even at relatively high temperatures. Molecular Sieve 3A (MS-3A), and 13X are synthetic zeolites that are high-temperature desiccants. The temperature for desiccant regeneration, or expulsion of sorbed water for MS-3A ranges from 175° to 350° centigrade. As shown in FIG. 5, numerous other desiccants with a variety of regeneration temperatures are available, depending upon the selection of a particular desiccant having a particular regeneration temperature. The desiccant regeneration temperature is selected to exceed temperatures encountered during operation tool operations while sorption cooling is desired to enable a continuous intake of water vapor by the higher temperature desiccant. For example, calcium oxide (CaO) chemisorbs water and retains that water to 1000 C. Once the regeneration temperature is reached, water vapor is no longer sorbed by the higher temperature desiccant, rather the water vapor that has already been taken in by the higher temperature desiccant is released.

Figure 4B:
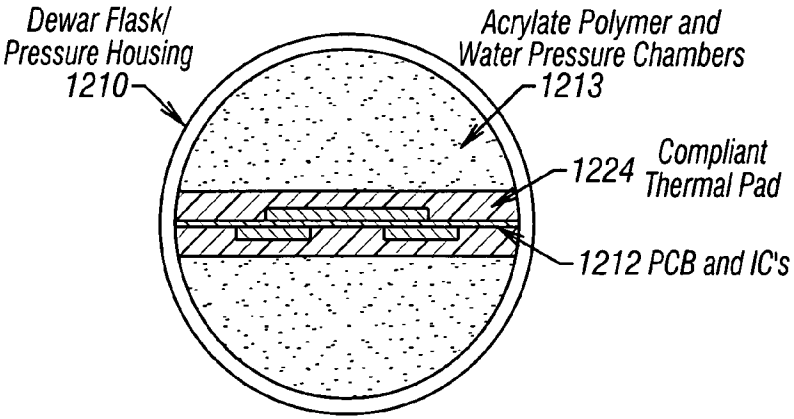
FIG. 4 is an illustration an exemplary embodiment of the present invention showing a highly heat-conductive polymer proximate to the circuit board for removing heat from the circuit board.
Figure 4A:
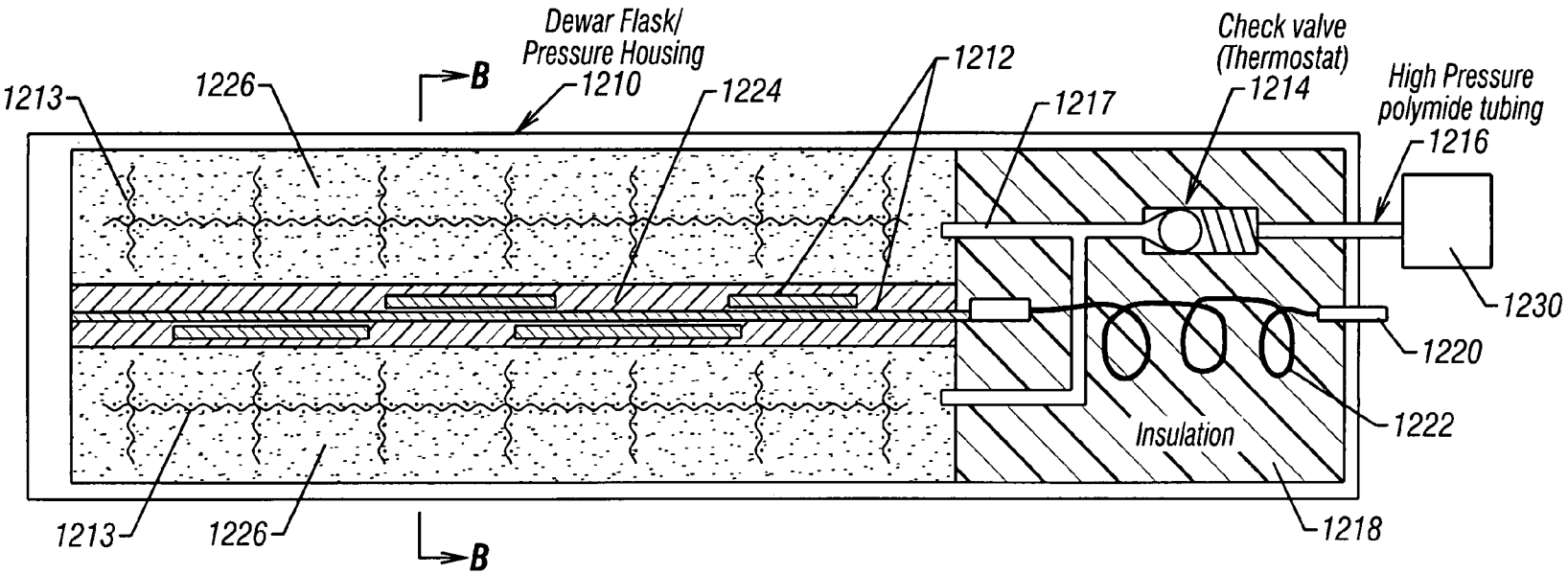

Turning now to FIGS. 4A and 4B, an exemplary embodiment of the present invention is depicted. FIG. 4A is a side view of a schematic representation of the present invention showing a Dewar flask/pressure housing 1210 surrounding a low temperature water source desiccant 1226, which can be any suitable desiccant selected for a desired operating temperature range. The low temperature solid source of water 1226 is placed adjacent an item to be cooled, such as a printed circuit board, processor or electronics 1212. In the present example, a compliant thermal pad 1224 having very high heat conductivity is optionally placed in contact with the circuit board and integrated circuits on the circuit board. It prevents hot spots from developing on the boards. The pad 1224 also facilitates conduction of heat from the circuit board 1212 to the desiccant 1226 for cooling of the circuit board. At a pre-selected vapor pressure, a check valve 1214, opens. It was chosen in accordance with FIG. 6 to maintain a relatively constant temperature in the electronics 1212 being cooled. That is, it maintains that temperature, which corresponds to the vapor pressure at which it opens. When the check valve opens at a desired vapor pressure, it allows vapor from solid source of water 1226 to flow through high pressure polyamide tubing 1217 and 1216 and on to high-temperature desiccant 1230. The check valve 1214 controls the rate of evaporation of water from solid source of water 1226 and the flux of vapor to the high-temperature sorbent 1230 by opening at a preselected vapor pressure to allow evaporation. The check valve 1214 closes when the vapor pressure associated with the solid source of water 1226 drops below the designed vapor pressure. FIG. 4B is a cross section taken along section line B-B of FIG. 4A. A thermally conductive coupler such as a wire mesh 1213 is distributed throughout the low temperature solid source of water 1226 water source to ensure equal evaporation of water vapor from the low temperature desiccant. Some additional thermal insulation 1218 is provided. To minimize heat transfer to the circuit board 1212 from the connector 1220 through the cable 1222, this cable is coiled to increase its length.

Turning now to FIGS. 5A, 5B and 5C, a list of suitable desiccants 1310 is given illustrating a subset of desiccants are shown along with their regeneration temperature 1320. Some of the desiccants are not recommended, as noted, because of the toxicity associated there with.

Figure 6:
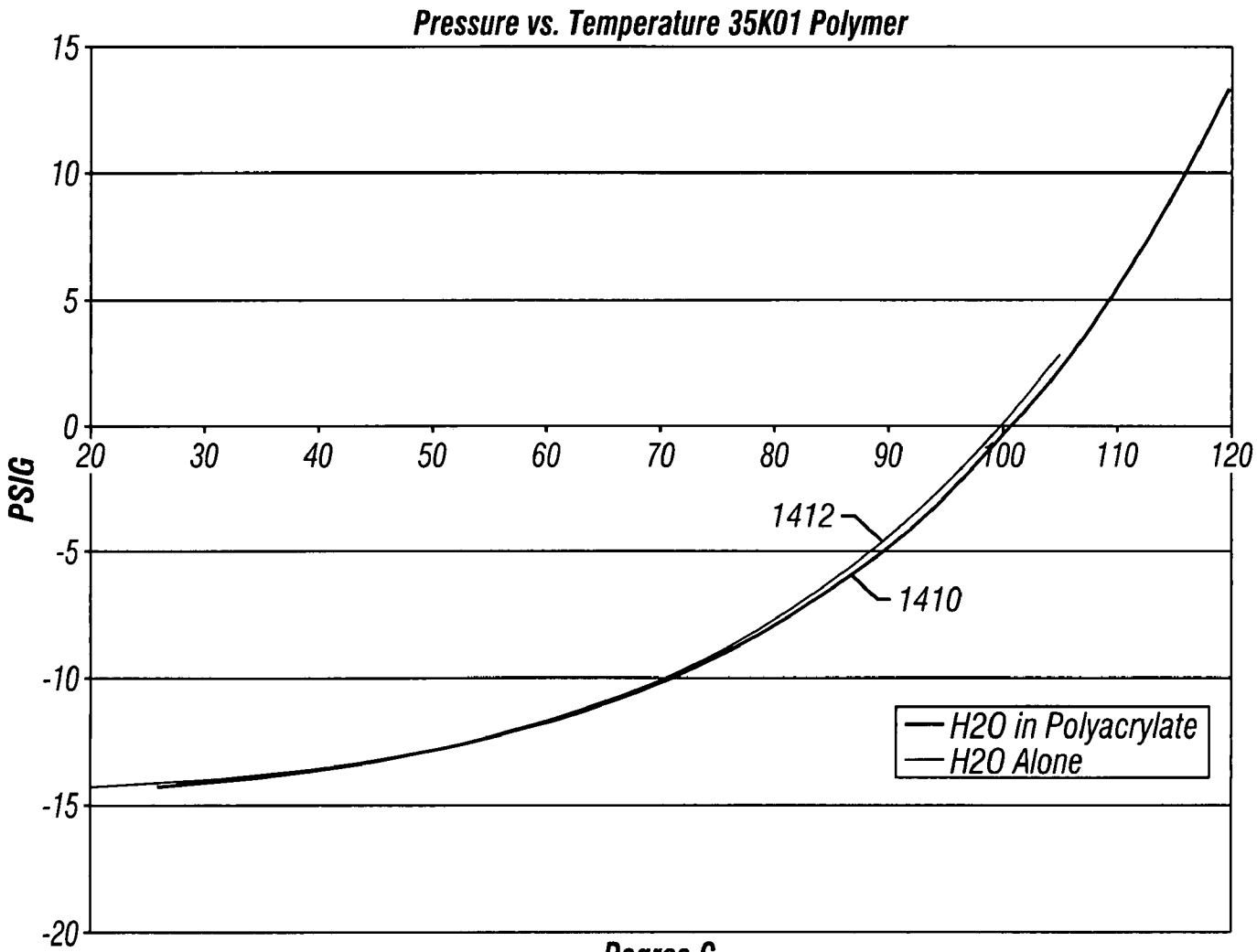
FIG. 6 illustrates that the temperature dependence of vapor pressure is approximately the same for liquid water as it is for water absorbed in a solid sodium polyacrylate matrix. A check valve based on this vapor pressure curve can be used to provide temperature regulation.

FIG. 6 is graph of the vapor pressure versus temperature for selection of check valve 1214 for maintaining a relatively constant temperature for the electronics 1212. A vacuum is pulled on each side of the check valve to facilitate water evaporation from the solid source of water and to facilitate its transfer to the high temperature desiccant.

While the foregoing disclosure is directed to the preferred embodiments of the invention various modifications will be apparent to those skilled in the art. It is intended that all variations within the scope and spirit of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

What is claimed is:

1. A sorption heating apparatus for use in a downhole tool comprising:

a solid source of liquid associated with a first region within the tool;

sodium polyacrylate located in a second region of the tool; and a passage between the first region and the second region configured to enable liquid vapor released from the solid source of liquid to pass from the first region to the second region and the sodium polyacrylate configured to soak up the liquid vapor thus removing heat from first region.

2. The apparatus of claim 1 further comprising: a check valve located between the first region and the second region configured to control a rate of water vapor production.

3. The apparatus of claim 2 wherein the check valve opens at a pre-selected vapor pressure to facilitate water vapor production in the first region.

4. The apparatus of claim 2 wherein the check valve comprises a pressure-sensitive device configured to facilitate water vapor production when a selected temperature is exceeded.

5. The apparatus of claim 1 wherein electronics are adjacent to a source of water and both are surrounded by a phase change material.

6. The apparatus of claim 1 further comprising: a thermal coupler associated with the solid source of liquid configured to distribute heat within it to facilitate release of liquid vapor from it.

7. The apparatus of claim 1, wherein electronics are adjacent to the solid source of liquid and both the electronics and solid source of liquid are substantially thermally insulated.

8. The apparatus of claim 1 further comprising: a thermally conductive material positioned between a device to be cooled and a desiccant to facilitate thermal coupling between the device and the solid source of liquid.

9. The apparatus of claim 1 wherein the second region is in thermal communication with a tool housing.

10. A method for heating a region in a downhole tool deployed on a wireline tool or a drill stem comprising:

releasing vapor from a solid source of liquid positioned in a first region within the down hole tool;

providing a desiccant located in a second region of the tool; and using sodium polyacrylate to sorb the vapor through a vapor passage between the first region and the second region, thereby enabling water vapor generated in the first region to pass from the first region through the vapor passage to the second region, thereby transferring heat from the first region to the second region.

11. The method of claim 10 further comprising: controlling a rate of water vapor production with a check valve located between the first region and the second region.

12. The method of claim 11 further comprising: opening the check valve at a pre-selected vapor pressure facilitating water vapor production in the first region.

13. The method of claim 11, wherein the check valve comprises a pressure-sensitive device which facilitates water vapor production when a selected temperature is exceeded.

14. The method of claim 10, wherein electronics are adjacent to a source of water and both are surrounded by a phase change material.

15. The method of claim 10 further comprising: distributing heat with a thermal coupler associated with the solid source of liquid to facilitate release of water from it.

16. The method of claim 10, further comprising: thermally insulating electronics and the solid source of liquid.

17. The method of claim 10 further comprising: positioning a thermally conductive material between a device to be cooled and the solid source of liquid to facilitate thermal coupling between the device and the desiccant.

18. The method of claim 10 further comprising: positioning the second region in thermal communication with a tool housing.

* * * * *